US012420902B2

(12) United States Patent
Wik et al.

(10) Patent No.: US 12,420,902 B2
(45) Date of Patent: Sep. 23, 2025

(54) METHOD FOR MANEUVERING A BOAT PROVIDED WITH A SINGLE DRIVE UNIT

(71) Applicant: VOLVO PENTA CORPORATION, Gothenburg (SE)

(72) Inventors: Lars Wik, Sävedalen (SE); Johan Tell, Gothenburg (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 144 days.

(21) Appl. No.: 18/512,113

(22) Filed: Nov. 17, 2023

(65) Prior Publication Data

US 2024/0182148 A1 Jun. 6, 2024

(30) Foreign Application Priority Data

Dec. 2, 2022 (EP) ..... 22211184

(51) Int. Cl.
*B63H 21/21* (2006.01)
*B63B 79/40* (2020.01)
*B63H 20/12* (2006.01)

(52) U.S. Cl.
CPC ..... *B63H 21/213* (2013.01); *B63B 79/40* (2020.01); *B63H 20/12* (2013.01); *B63H 2021/216* (2013.01)

(58) Field of Classification Search
CPC ..... B63H 21/213; B63H 20/12; B63H 2021/216; B63B 79/40
See application file for complete search history.

(56) References Cited

U.S. PATENT DOCUMENTS 9,862,473 B2 * 1/2018 Rydberg ..... B63B 39/00
11,904,996 B2 * 2/2024 Derginer ..... G05D 1/0875
2005/0287882 A1 12/2005 Muller
2009/0004930 A1 1/2009 Larsson
(Continued)

FOREIGN PATENT DOCUMENTS

WO 2021231809 A1 11/2021

OTHER PUBLICATIONS

Extended European Search Report in corresponding European Application No. 22211184.1 dated Jun. 7, 2023 (5 pages).

*Primary Examiner* — Ramsey Refai
(74) *Attorney, Agent, or Firm* — Venable LLP; Jeffri A. Kaminski

(57) ABSTRACT

A computer-implemented method for maneuvering a boat provided with a single drive unit, includes: Obtaining net momentum direction data indicative of a target horizontal rotational movement of the hull, triggering a series of bursts of thrust by the drive unit, said series of bursts of thrust comprising a plurality of primary bursts and a plurality of secondary bursts directed differently than the primary bursts, The primary bursts and the secondary bursts are directed such that they provide a respective longitudinal thrust component parallel to a hull longitudinal axis. The primary bursts are directed such that the longitudinal thrust components of the primary bursts act in the opposite direction with respect to the direction of the longitudinal thrust components of the secondary bursts. The primary bursts and the secondary bursts are further directed such that they jointly provide a net momentum on the hull associated with said net momentum direction data.

20 Claims, 9 Drawing Sheets

(56) References Cited

U.S. PATENT DOCUMENTS

| | | | | |
|---|---|---|---|---|
| 2016/0288893 | A1 | 10/2016 | Rydberg et al. | |
| 2022/0063787 | A1 | 3/2022 | Derginer et al. | |
| 2022/0363362 | A1 | 11/2022 | Inoue | |
| 2023/0391423 | A1* | 12/2023 | Paton | B63H 21/17 |

* cited by examiner

METHOD FOR MANEUVERING A BOAT PROVIDED WITH A SINGLE DRIVE UNIT

TECHNICAL FIELD

The present disclosure relates to maneuvering of boats, including leisure boats, yachts and ships. More specifically, the present disclosure relates to a computer-implemented method for maneuvering a boat provided with a single drive unit. The method provides improved control of rotation and translation of such a boat, for example using an input from a joystick. The present disclosure is typically useful for assisted docking operations.

BACKGROUND

Boats are often provided with two or more drive units, such as drive units mounted on the transom of the boat, said drive units being either outboard motors or drive units connected to inboard motors. Some boats use two fixed propeller shafts mounted on a port side and on a starboard side of the hull, respectively.

The provision of two or more drive units on a boat enables the drive units to simultaneously provide thrust in different directions, thereby rotating the boat and/or translating the boat. Fixed shaft boats are somewhat limited as to in which directions thrust can be provided by the respective propellers, since each propeller can only provide a forward or rearward thrust. Fixed shaft boats are often provided with rudders to redirect the rearward thrust slightly to the port or starboard side of the boat, but the rudder has little to no effect when reversing the propeller direction.

Recent developments, especially for outboard motors, enables assisted docking controlled by a joystick, by using a control unit actively controlling the direction and power of thrust provided by each outboard motor to thereby control rotation and translation of the boat, for example to keep the boat stationary or to enable easier docking.

Boats can also be provided with bow thrusters and aft thrusters to provide additional control of sideways movement of the bow or aft portions of the boat.

However, not all boats are provided with multiple drive units, and therefore are not able to enjoy these types of assisted docking solutions for control of the rotation and translation of the boat.

SUMMARY

An object of the invention is to enable improved maneuverability of boats provided with a single drive unit.

The method is for maneuvering a boat provided with a single drive unit, said boat comprising a hull having a longitudinal extent along a hull longitudinal axis, and a lateral extent along a hull lateral axis. The drive unit comprises a mount attaching the drive unit to the hull along said hull longitudinal axis, and a lower unit comprising a propeller shaft for carrying a propeller for generating thrust. The lower unit is configured such that the lower unit, or at least a portion of the lower unit carrying the propeller shaft, is rotatable about a steering axis such that a direction of a horizontal component of the thrust is variable in a horizontal plane by rotation of the lower unit about the steering axis.

The method comprises:

obtaining, by a processor device of a computer system, net momentum direction data indicative of a target horizontal rotational movement of the hull.

The method further comprises triggering, by the processor device, a series of bursts of thrust by the drive unit, said series of bursts of thrust comprising a plurality of primary bursts and a plurality of secondary bursts directed differently than the primary bursts. The primary bursts and the secondary bursts are directed such that they provide a respective longitudinal thrust component parallel to the hull longitudinal axis. The primary bursts are directed such that the longitudinal thrust components of the primary bursts act in the opposite direction with respect to the direction of the longitudinal thrust components of the secondary bursts. The primary bursts and the secondary bursts are further directed such that they jointly provide a net momentum on the hull associated with said net momentum direction data.

The series of bursts of thrust may act in different directions and jointly contribute to provide at least a net momentum on the hull in a horizontal plane, which could be a zero net momentum or a positive net momentum in any momentum direction chosen based on the momentum direction data.

The primary bursts together provide a net longitudinal force component at least partly counteracting a net longitudinal force component provided by the secondary bursts.

By adapting the power (intensity and time) of each burst, a net longitudinal force applied by the series of bursts along the hull longitudinal axis is controllable, for example to be zero/neutral, or to act to propel the boat forward or backward.

Since the primary bursts and the secondary bursts are also directed such that they jointly provide a net momentum on the hull associated with said net momentum direction data, control of rotational movement and of longitudinal movement can be achieved using only a single drive unit, with reduced manual attention required by an operator of the boat, and with less space required around the boat for achieving the rotational maneuver.

The method may use any suitable control strategy for controlling a net longitudinal direction of movement, for example a dynamically user controllable net direction, or a statically defined net movement such as forward, backward or neutral/still.

Further, the method may use any suitable control strategy for controlling a net longitudinal force/speed of movement, for example a dynamically user controllable net longitudinal force, or a statically defined net longitudinal force. Further, one or more sensors may be used provide information about actual position or acceleration of the boat, wherein the method could comprise adapting the strength and direction or thrust to achieve a target rate of translation of the position of the boat, which would account for external factors acting on the boat, such as wind and water currents. The rate of translation of the boat could be dynamically user controllable, or it could be a static rate.

Net momentum direction data may for example be provided by an automated navigation system programmed to perform specific maneuvers and/or follow a specific path, or the net momentum direction data may be provided by manual control by an operator of the boat. For example, the operator may operate a joystick controlling output of at least net momentum direction data. In the case of manual control, this means that the operator only needs to ensure that net momentum direction data is available and can thus focus control efforts on monitoring actual rotational movements of the vessel and adapting the manual input to control at least the momentum direction data as required, for example by continuously adjusting the joystick (or other suitable control device) until the boat reaches and/or maintains an intended rotational position.

The method may use any suitable control strategy for determining net momentum strength, for example using a dynamically user controllable momentum strength, or a statically defined momentum strength. Further, one or more sensors may be used provide information about actual position or acceleration of the boat, wherein the method could comprise adapting the momentum strength to a target rate of change of the rotational position of the boat, which would account for external factors acting on the boat, such as wind and water currents. The rate could be dynamically user controllable, or it could be a static rate.

Further, the method may use any suitable control strategy for controlling a net longitudinal force/speed of movement, for example a dynamically user controllable net longitudinal force, or a statically defined net longitudinal force.

Also, it should be understood that the speed of the propeller shaft(s) is lowered between consecutive bursts; However, the speed of the propeller shaft(s) must not necessarily be lowered to standstill of the propeller shaft(s) between consecutive bursts.

Also, all primary bursts must not necessarily have the same direction, nor the same power. Similarly, all secondary bursts must not necessarily have the same direction, nor the same power.

The method may further comprise obtaining, by the processor device, net force direction data indicative of a target horizontal translational movement of the hull, wherein the direction of the primary bursts and of the secondary bursts are further such that the primary bursts and secondary bursts jointly provide a net force on the hull associated with the target horizontal translational movement of the hull.

The target horizontal translational movement may be directed in any horizontal direction and thus be used to derive the net longitudinal thrust component and a net lateral thrust component directed perpendicularly to the hull longitudinal axis. By adjusting the direction and net power of the primary burst and of the secondary bursts, the hull will be affected by a net lateral force component in a net lateral force direction associated with the net force direction data, and by the net longitudinal force discussed above.

The triggered series of bursts may alternate between respective ones of, or respective subsets of, the primary bursts, and respective ones of, or respective subsets of, the secondary bursts.

Firstly, it should be understood that not all primary bursts must necessarily have a same direction and a same power, although they could have. Also, not all secondary bursts must necessarily have a same direction and a same power, although they could have. Secondly, if all primary bursts would be provided first, and all secondary bursts would be provided after all the primary bursts, the boat would be given a relatively large translational movement in one direction before the secondary bursts are applied. By providing the primary bursts and the secondary bursts in an alternating fashion, as described above, a relatively small translational movement of the hull is made possible, since the longitudinal components of the forces applied at least partly cancel each other out. This enables rotation of the boat without, or with only little, horizontal translational movement of the boat. This increases accuracy of the movement of the boat (including accuracy of any rotational and any translational movement intended).

Each burst of said series of bursts may be directed such that it provides a respective lateral thrust component perpendicular to the hull longitudinal axis, wherein the respective lateral thrust components of the primary bursts are directed in a same direction as the direction of the respective lateral thrust components of the secondary bursts, wherein the primary bursts and the secondary bursts jointly contribute to a net lateral force on the hull in said associated with a lateral component of the target horizontal translational movement.

Since both the primary burst and the secondary bursts contribute to a net lateral force component, they collaborate with each other and do not work against each other, thus enabling a higher efficiency of the thrust power used for achieving lateral movement of the hull.

A respective rotational direction of the propeller(s) may be reversed for the secondary bursts as compared to the respective rotational direction of the propeller(s) used for the primary bursts.

Reversing the rotational direction of a propeller reverses its thrust direction. Reversing the propeller thrust direction enables unconstrained operation also for drive units not capable of rotating 360 degrees in a horizontal plane, for example transom mounted drive units. Also, reversal of the rotational direction of the propeller(s) enables shorter travel between a drive unit position from which the primary bursts are applied and a drive unit position from which the secondary bursts are applied. For example, FIG. 4*a* shows the same thrust angle as the one shown in FIG. 4*b*, and FIG. 5*a* shows the same thrust angles as shown in FIG. 5*b*. In FIGS. 4*a* and 4*b*, the steering angle of the drive unit is changed less between the primary bursts and the secondary bursts, than in the operation shown in FIGS. 4*b* and 5*b* where the drive unit has to rotate much longer to be able to achieve the same thrust direction. The rotational direction of the propeller(s) can be the same for the primary and the secondary burst in the FIG. 4*b* operation, whereas the rotational direction of the propeller(s) has to be changed in the FIG. 4*a* operation to achieve the correct thrust direction. Transom mounted drive units typically cannot be operated as shown in FIGS. 4*b* and 5*b*.

The drive unit may be configured such that a pivot point of the lower unit at an intersection of the steering axis and a central axis of the propeller shaft, is laterally movable with respect to the hull longitudinal axis between a starboard operative range on a starboard side of the hull longitudinal axis, and a port operative range on the port side of the hull longitudinal axis. Also, the primary bursts may be provided with the lower unit positioned such that the pivot point is within the starboard operative range, wherein the secondary bursts are provided with the lower unit positioned such that the pivot point is within the port operative range.

The lateral movement of the pivot point enables lateral movement of the longitudinal axis along which application of thrust is provided by the propeller(s) and thus enables a net momentum (for rotation of the hull in a horizontal plane) to be applied to the hull whilst enabling control of the net force direction and net force strength. This further enables rotation on the spot with little to no net lateral or, net longitudinal, translation of the hull, as shown in FIGS. 8-13. Since both net momentum and net force is controllable, it is also possible to provide little to no net momentum whilst still being able to move the hull laterally only as shown in FIGS. 14-17. From any pivot point position, it is possible to alter the strength and direction of momentum applied by altering the steering angle; For example to reach a state where the momentum from the primary bursts cancel the momentum from the secondary bursts, or to reach a state where the series of bursts are directed towards a center of mass of the boat, such that the bursts do not create a momentum around the center of mass, and hence a zero/neutral net momentum.

The drive unit may further comprise a central body rotatably attached to the mount for rotation about a first rotational axis extending substantially vertically, or extending with an angle to a vertical axis within the range of 1-20 degrees, such as within 1-10 degrees, wherein the lower unit is attached to the central body radially offset with respect to the first rotational axis such that the steering axis is laterally movable with respect to the hull longitudinal axis by rotation of the central body about the first rotational axis.

The lower unit may be rotatably attached to the mount for rotation of the lower unit about a second rotational axis substantially parallel to the hull longitudinal axis, wherein the propeller shaft is radially offset from the second rotational axis such that the propeller shaft is movable laterally with respect to the hull longitudinal axis by rotation of the lower unit about the second rotational axis.

Each burst of said series of bursts may be directed along a respective directional axis extending straight through a vertical reference axis extending through a center of mass of the boat.

The method mat further comprise obtaining, by the processor device, net momentum strength data and net force strength data, and may further comprise controlling, by the processor device, direction and/or power of the respective bursts of the series of bursts based on the net momentum strength data and based on the net force strength data.

The method may further comprise providing a manually operable input device configured to enable user input of at least a net force direction and/or a net momentum direction, said method further comprising providing, by the processor device, said net force direction data and/or said net momentum direction data based on said user input from the input device.

The input device may also be configured to enable user input of at least a net force strength and a net momentum strength, said method further comprising providing, by the processor device, said net force strength data and said net momentum strength data based on said user input from the input device.

The user input device may further comprise a joystick.

The joystick may be a joystick with three or more axes of control.

The joystick may comprise a joystick lever and may be a progressive input joystick configured enable user input of both said net force direction and of a net force strength based on the direction of tilt of the joystick lever and amount of tilt of a joystick lever, and configured to enable user input of both said net momentum direction, based on the direction of rotation of the joystick lever about a longitudinal axis of the joystick lever, and of a net momentum strength, based on the amount of rotation of the joystick lever about the longitudinal axis of the joystick lever.

According to a second aspect of the present disclosure, the above mentioned object may also be achieved by the computer system, which may comprise the processor device configured to perform the method, also discussed above.

According to a third aspect of the present disclosure, the above mentioned object may also be achieved by a control system. The control system comprises one or more control units configured to perform the, also discussed above.

According to a fourth aspect of the present disclosure, the above mentioned object may also be achieved by a computer program product. The computer program product comprises program code for performing, when executed by the processor device, the method, also discussed above.

According to a fifth aspect of the present disclosure, the above mentioned object may also be achieved by a boat comprising the above mentioned computer system comprising the processor device configured to perform, when executed by the processor device, the method, as discussed above.

According to a sixth aspect of the present disclosure, the above mentioned object may also be achieved by a non-transitory computer-readable storage medium, said storage medium comprising instructions, which when executed by the processor device, cause the processor device to perform the method, also discussed above.

Different embodiments of the boat may thus comprise the respective hardware components.

The above aspects, accompanying claims, and/or examples disclosed herein above and later below may be suitably combined with each other as would be apparent to anyone of ordinary skill in the art.

Additional features and advantages are disclosed in the following description, claims, and drawings, and in part will be readily apparent therefrom to those skilled in the art or recognized by practicing the disclosure as described herein. There are also disclosed herein control units, computer readable media, and computer program products associated with the above discussed technical benefits.

BRIEF DESCRIPTION OF THE DRAWINGS

All figures are schematic drawings. For clarity, like reference numerals are not repeated in all figures for the same elements.

The illustrated embodiments are merely illustrative, and in other embodiments, a combination of longitudinal and lateral translation in any direction is also possible, by appropriately adapting power and direction of primary and secondary bursts, with or without rotation or the hull.

Figure 1:
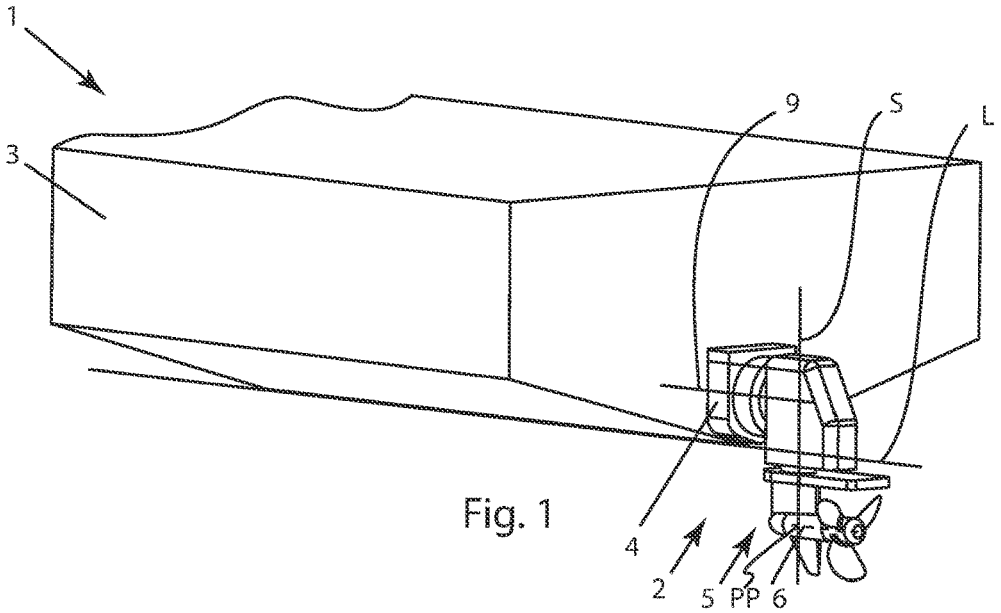

FIG. 1 shows a perspective view of a rear cut-away portion of a boat according to a first embodiment.

Figure 2:
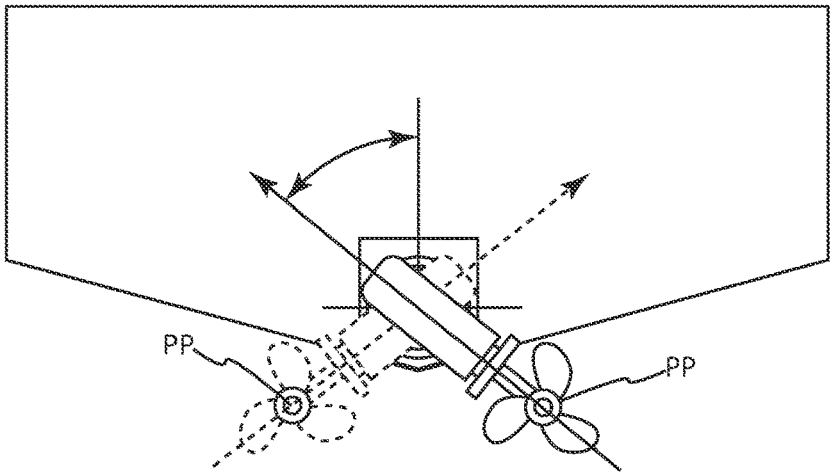

FIG. 2 shows a rear view of the boat also shown in FIG. 1.

Figure 3:
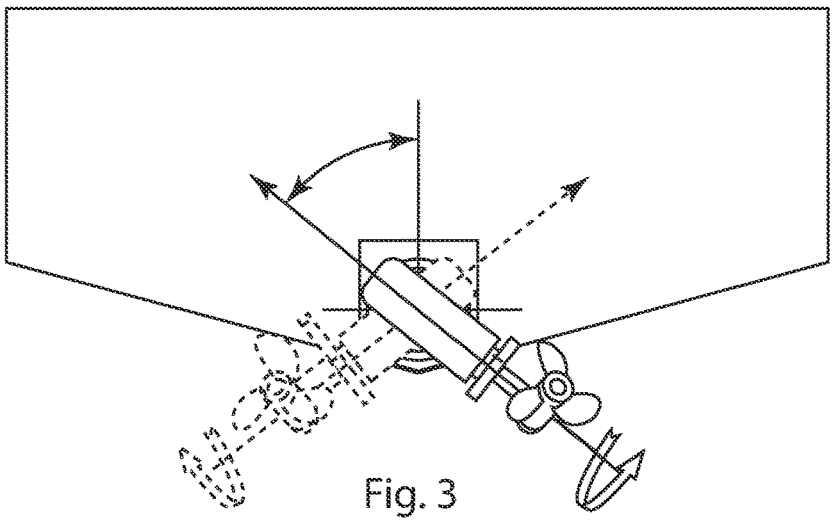

FIG. 3 shows a rear view of the boat also shown in FIG. 2, with a portion of a lower unit of a drive unit rotated about a steering axis, as compared to position of the portion of the lower unit shown in FIG. 2.

FIGS. 4*a*, 4*b*, 5*a*, 5*b*, and 6-19 show schematic views from above of the boat also shown in FIGS. 1-3, each view illustrating a different type of maneuver indicated by respective arrow symbols DT and circular arrow symbols DR, and with directions of the primary and secondary bursts indicated by arrows to/from the position(s) of the propeller(s) and along the direction of the propeller shaft.

Figure 4A:
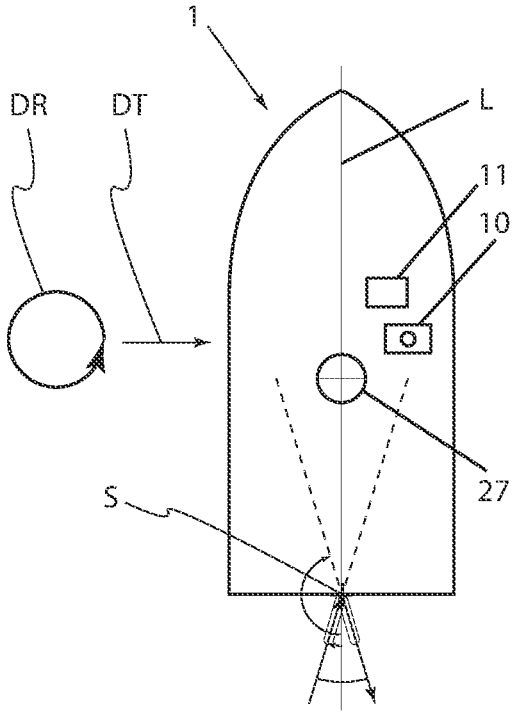
In FIGS. 4*a*, 4*b*, 5*a*, 5*b*, and 6-19, the circular arrow symbol DR indicates either clockwise rotation or counterclockwise rotation of the hull as seen from above and the position of the symbol does not relate to a center of rotation of the rotational movement indicated. Likewise, the arrow symbol DT indicates direction of translation of the hull.

FIG. 4*a* shows counterclockwise rotation of the boat combined with sideways translation of the boat in a starboard direction. Here, the propeller direction of rotation is reversed between the primary and secondary bursts.

Figure 5A:
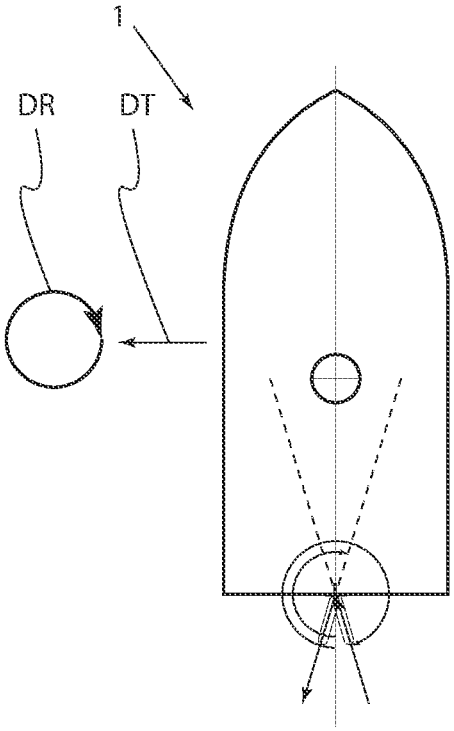

FIG. 5*a* shows clockwise rotation of the boat combined with sideways translation of the boat in a port direction. Here, the propeller direction of rotation is reversed between the primary and secondary bursts.

Figure 4B:
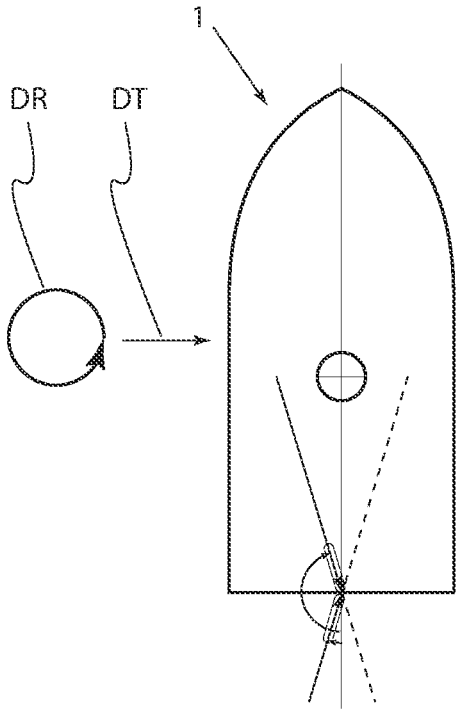

FIG. 4*b* shows counterclockwise rotation of the boat combined with sideways translation of the boat in a starboard direction. Here, the propeller direction of rotation is not reversed between the primary and secondary bursts.

Figure 5B:
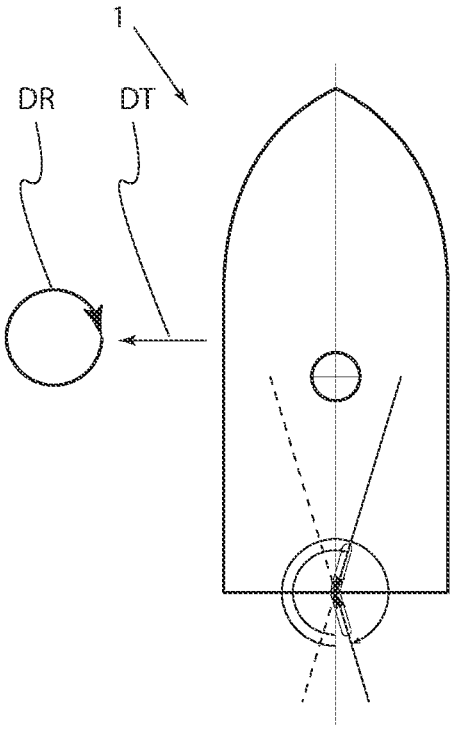

FIG. 5*b* shows clockwise rotation of the boat combined with sideways translation of the boat in a port direction. Here, the propeller direction of rotation is not reversed between the primary and secondary bursts.

Figure 6:
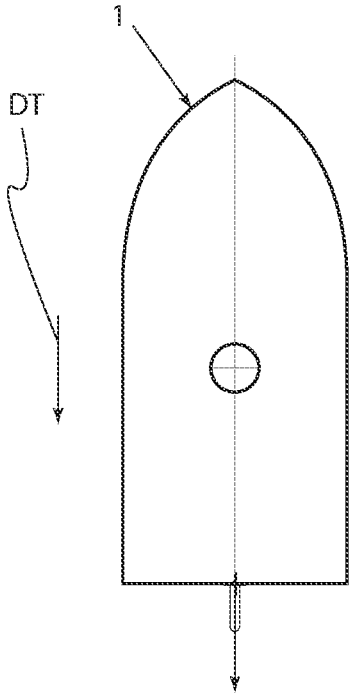

FIG. 6 shows rearward translation of the boat.

Figure 7:
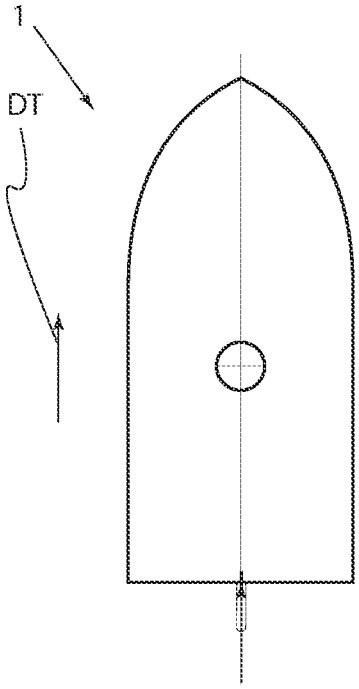

FIG. 7 shows forward translation of the boat.

Figure 8:
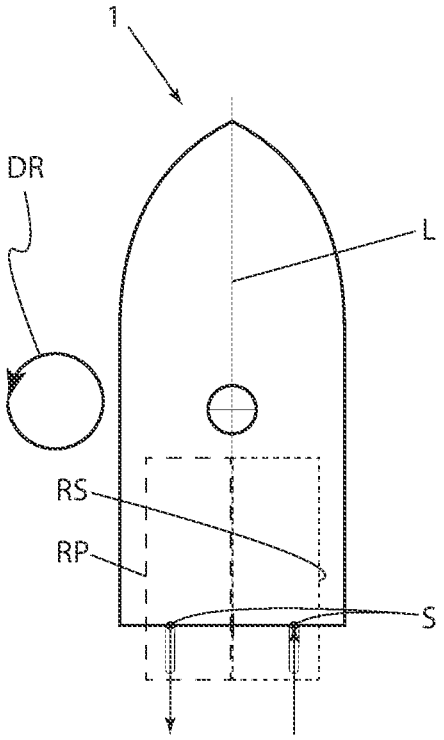

FIG. 8 shows counterclockwise rotation of the boat without translation of the boat.

Figure 9:
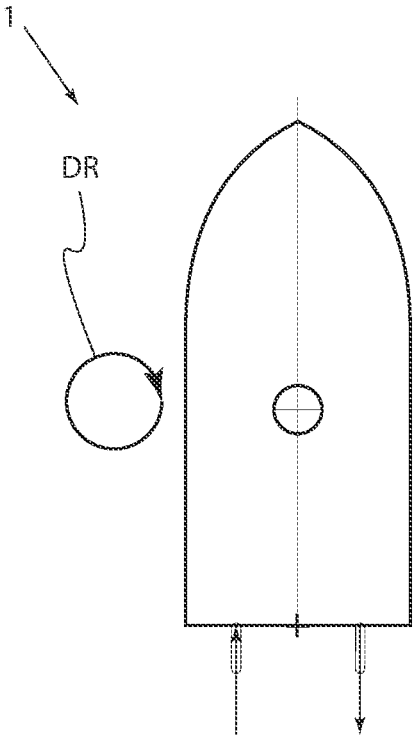

FIG. 9 shows clockwise rotation of the boat without translation of the boat.

Figure 10:
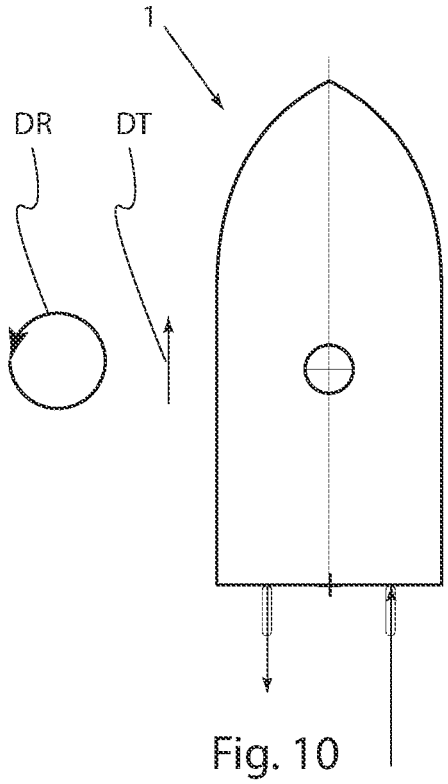

FIG. 10 shows counterclockwise rotation of the boat combined with a forward translation of the boat but no sideways translation of the boat.

Figure 11:
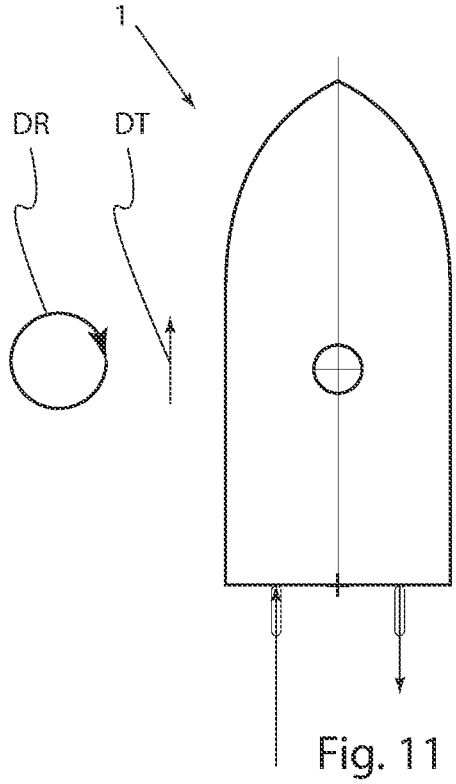

FIG. 11 shows clockwise rotation of the boat combined with a forward translation of the boat but no sideways translation of the boat.

Figure 12:
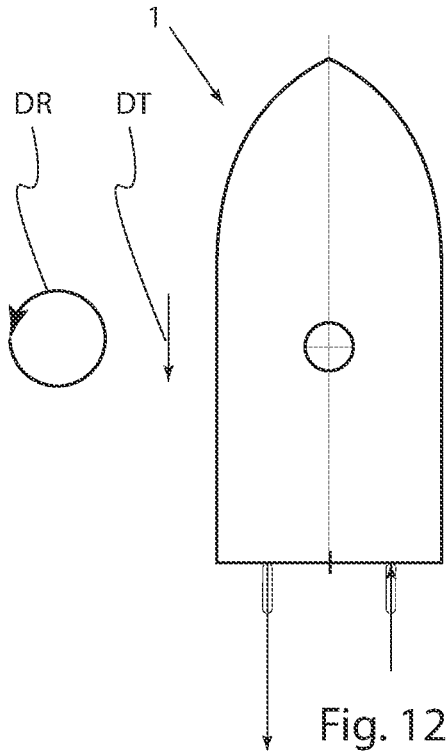

FIG. 12 shows counterclockwise rotation of the boat combined with a rearward translation of the boat but no sideways translation of the boat.

Figure 13:
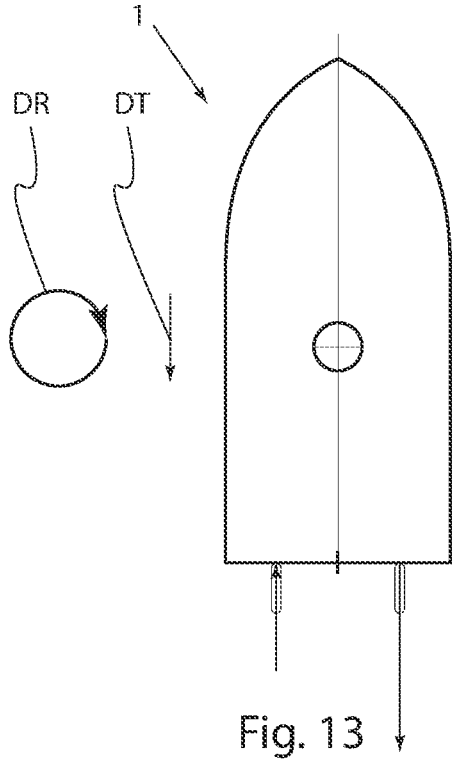

FIG. 13 shows clockwise rotation of the boat combined with a rearward translation of the boat but no sideways translation of the boat.

Figure 14:
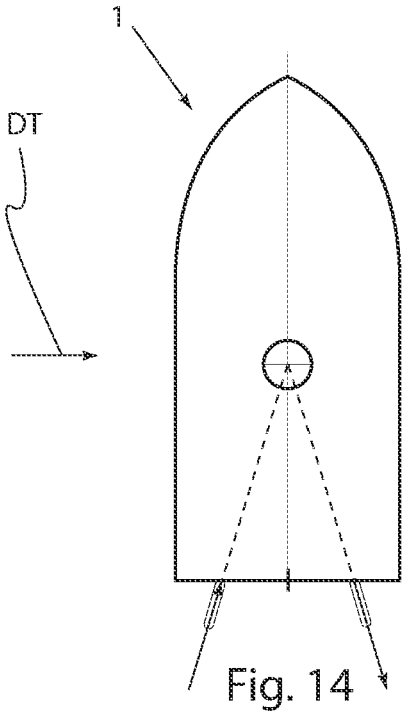

FIG. 14 shows sideways translation in a starboard direction without rotation of the boat and without translation of the boat in the longitudinal direction of the boat.

Figure 14A:
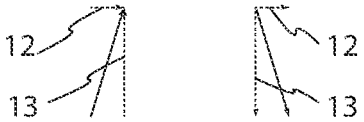

FIG. 14*a* shows the net forces of each burst applied on the boat in FIG. 14, along with corresponding lateral components and longitudinal components of each net force shown in broken lines.

Figure 15:
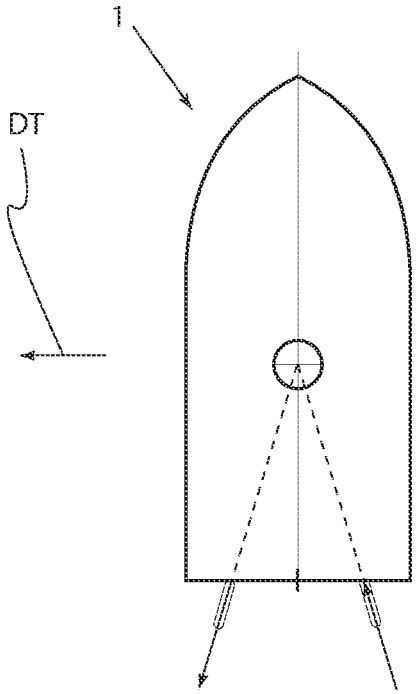

FIG. 15 shows sideways translation in a starboard direction without rotation of the boat and without translation of the boat in the longitudinal direction of the boat.

In FIGS. 14 and 15, the directions of thrust of the respective primary and secondary bursts are aligned with the center of gravity of the boat, such that the boat is translated without applying momentum causing rotation of the boat (about a vertical axis).

FIG. 16-19 shows examples of directions of thrust not aligned with the center of gravity of the boat.

Figure 16:
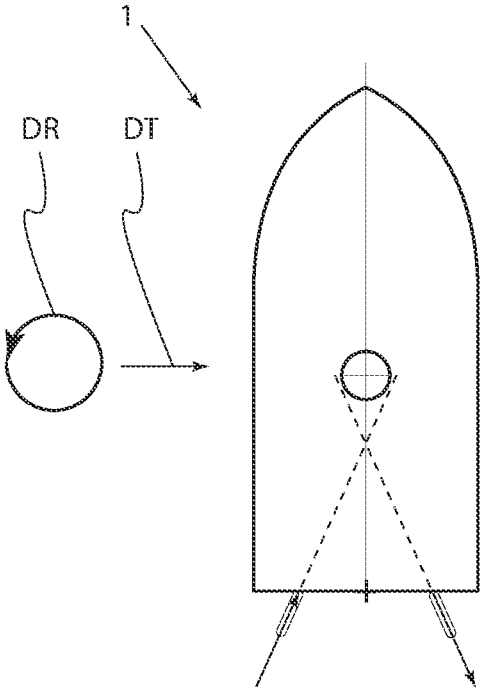
Figure 18:
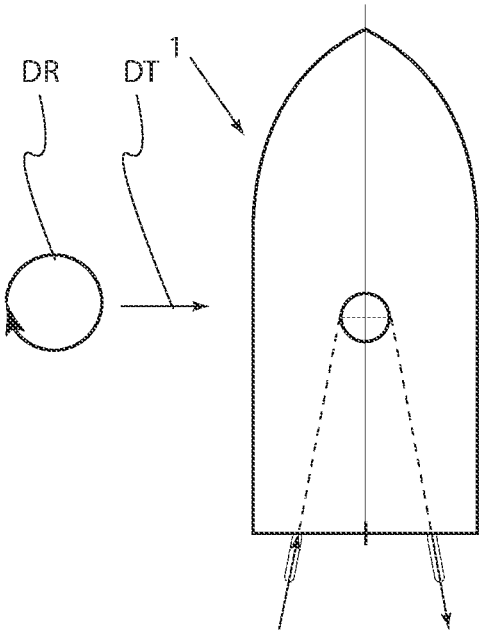
Figure 19:
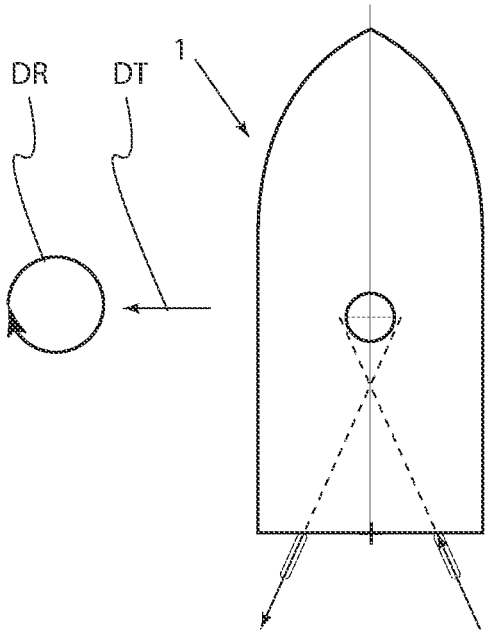

As shown in FIGS. 16 and 18, slightly changing the direction of the bursts controls rotation of the boat even though the bursts are provided from the same positions of the lower drive unit.

Figure 17:
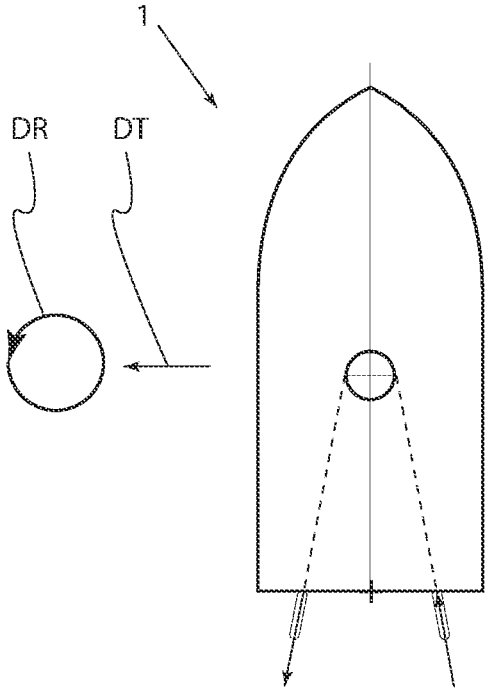

In FIG. 18, the rotational direction of the propeller is reversed as compared to the situation shown in FIG. 17, thereby reversing the rotational direction and the direction of translation of the boat.

The translations (movements) shown in the figures are net translations. Hence, it should be understood that individual bursts may be followed by a small translation subsequently cancelled in full or in part by a subsequent burst in some other direction.

Figure 20:
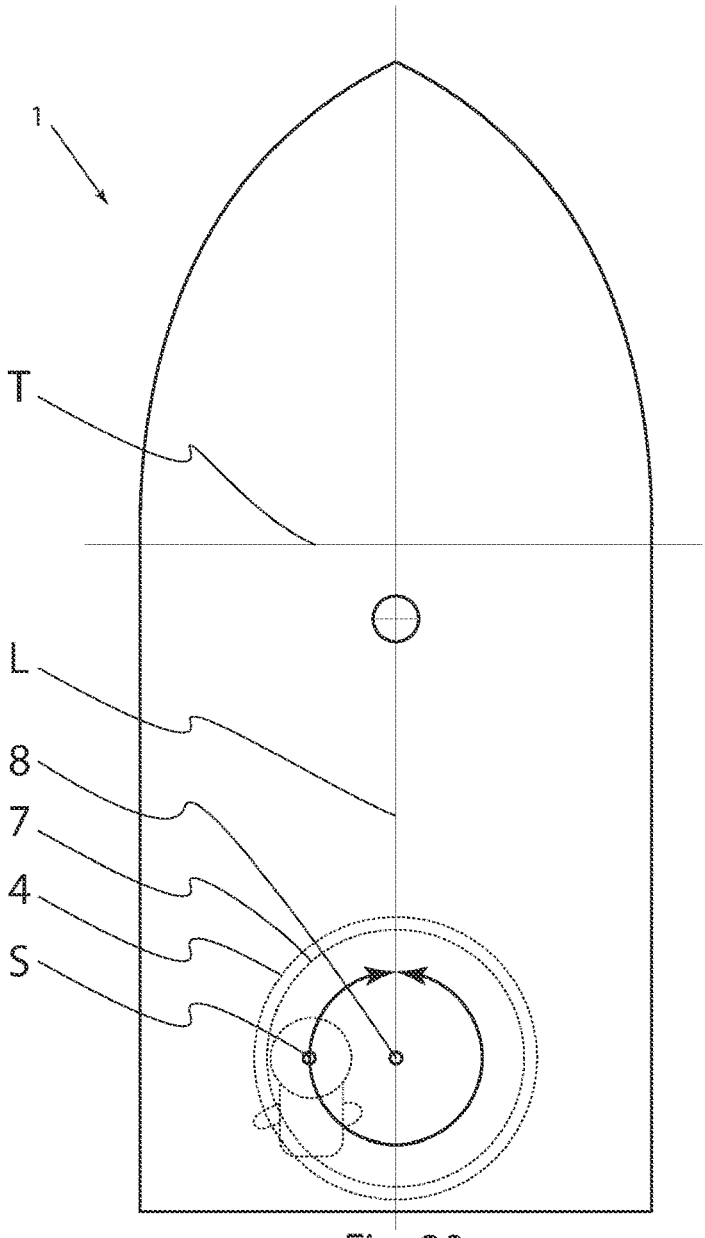

FIG. 20 shows a boat according to a second embodiment, said boat comprising a differently designed drive unit attached below the hull of the boat via a rotatable central body such that a steering axis of the drive unit is laterally movable with respect to the hull longitudinal axis by rotation of the central body about the first rotational axis. This allows the thrust to have only a horizontal component, independently of the direction of thrust.

Figure 21:
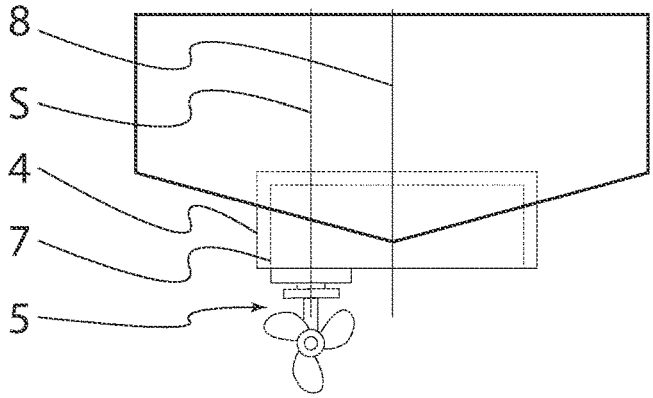

FIG. 21 shows a rear view of the boat also shown in FIG. 20.

Figure 22:
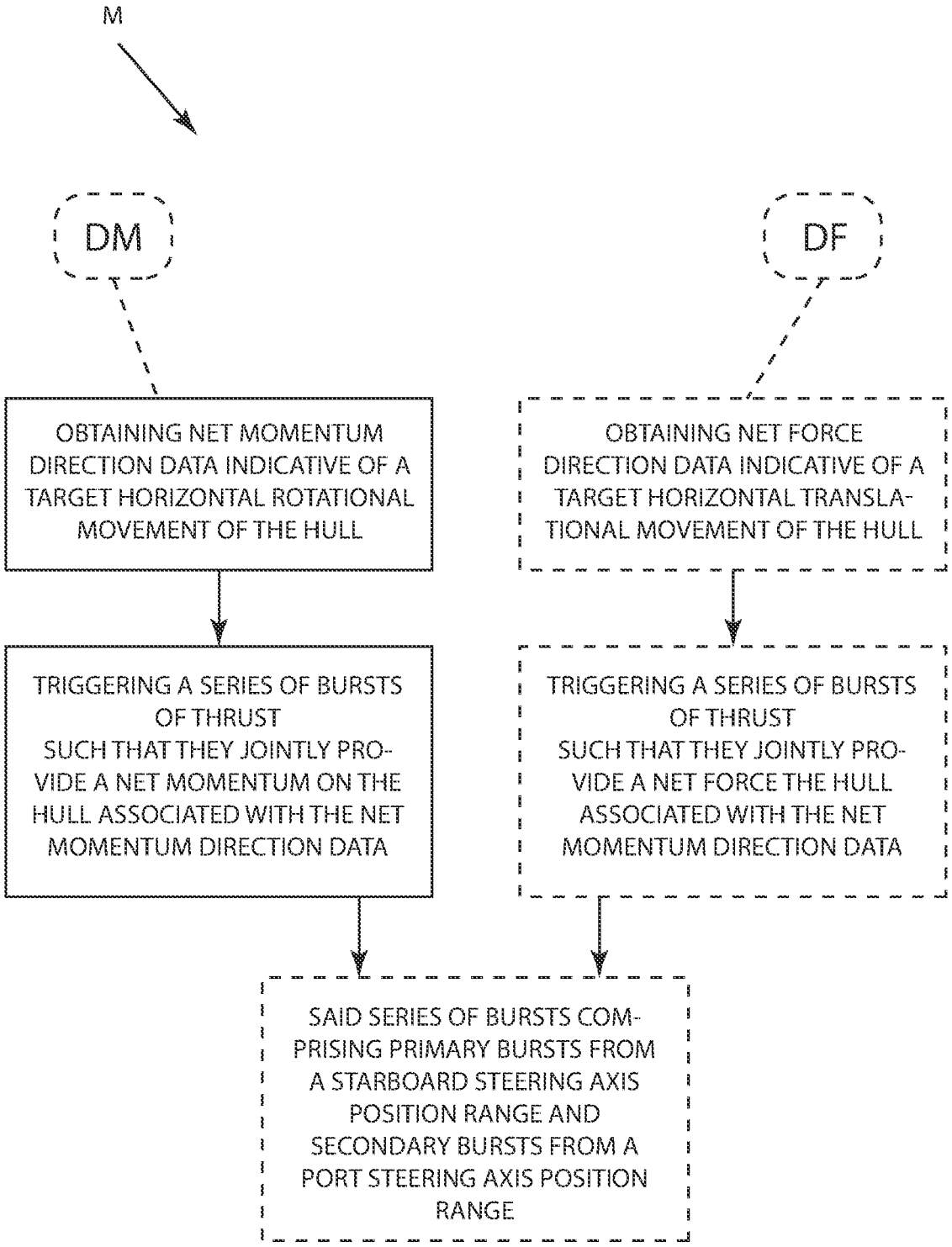

FIG. 22 shows a schematic view of the method for maneuvering the boat.

Figure 23:
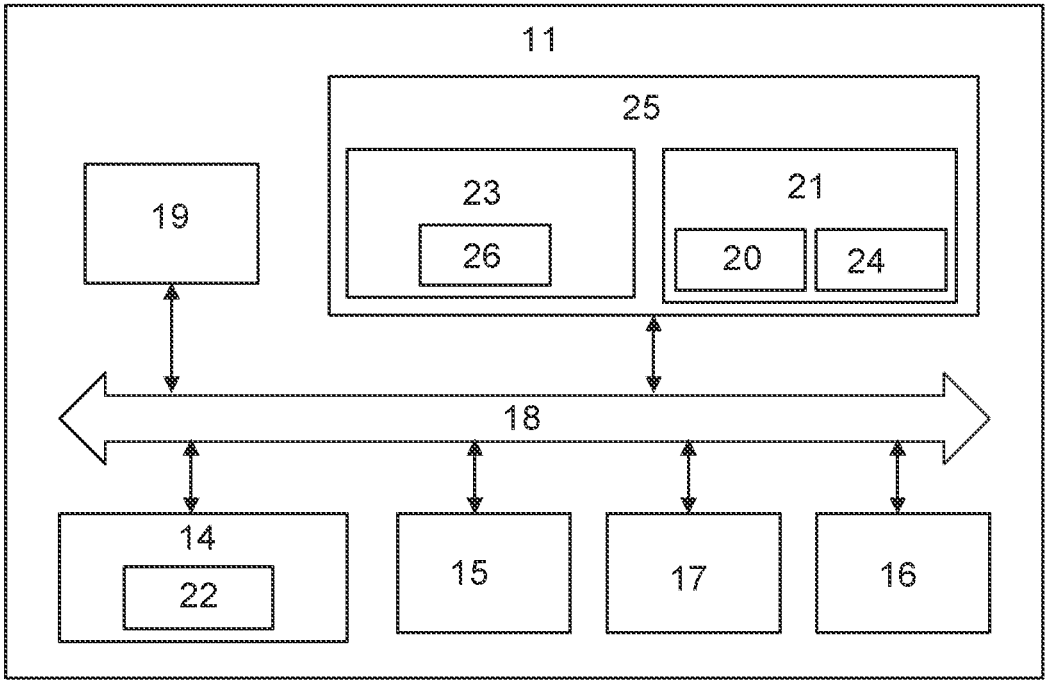

FIG. 23 shows a schematic diagram of a computer system for implementing examples disclosed herein.

DETAILED DESCRIPTION

Aspects set forth below represent the necessary information to enable those skilled in the art to practice the disclosure. Embodiments of the present disclosure will hereinafter be described with reference to the appended drawings.

As mentioned above, an object of the invention is to enable improved maneuverability of boats provided with a single drive unit 2.

Depending on the design of the drive unit 2, the degrees of freedom related to in which directions, and from which positions, thrust may be provided by the drive unit 2, varies. In a basic embodiment, a standard rear mounted drive unit 2 rotatable about a steering axis can be used. When the method is applied to such a drive unit 2, the method is limited as to what movements of the boat 1 are possible, similar to what is shown in FIGS. 4*a*, 4*b*, 5*a*, 5*b*, 6, and 7. Nevertheless, the method still proves very useful as compared to manual control of the drive unit 2. For example, the method enables the person controlling the boat 1 to focus on how the boat 1 moves and the surroundings of the boat 1 during docking, rather than focusing on how to operate the drive unit 2 to control movements of the boat 1. Instead of relying on a manual user input for providing net momentum direction data DM, the method may also be used as part of an autonomous control system requiring no manual input.

In other embodiments, the drive unit 2 may be designed such that the lateral position of the propeller shaft 6 is adjustable in addition to adjustment of the direction of the propeller shaft 6. This enables additional possible combinations of translation and rotation of the boat 1, such as pure rotation (i.e. without any substantial net translation of the boat 1). See for example FIGS. 8-19.

The drive unit 2 could for example be configured as shown in FIGS. 1-3 such that it is able to swing about an axis parallel to the hull longitudinal axis L, thus laterally translating the propeller shaft 6. In this embodiment, the propeller shaft 6 is still rotatable about a steering axis to adjust the direction of thrust starboard/port, as shown in FIG. 3.

Another feasible embodiment of the drive unit 2 is shown in FIGS. 20 and 21. Here, the drive unit 2 comprises a central body 7 rotatably attached to the mount 4 for rotation about a first rotational axis 8 extending substantially vertically, or extending with an angle to a vertical axis within the range of 1-20 degrees, such as within 1-10 degrees. The lower unit 5 is attached to the central body 7 radially offset with respect to the first rotational axis 8 such that the steering axis S is laterally movable with respect to the hull longitudinal axis L by rotation of the central body 7 about the first rotational axis 8. The drive unit 2 may be fully or partly retractable into the hull 3 of the boat 1.

Generally, the present disclosure is related to the method of controlling the drive unit and is not to be construed as limited to specific embodiments of the drive unit 2 set forth herein.

The computer-implemented method M for maneuvering the boat 1 is thus for a boat 1 provided with a single drive unit 2, said boat 1 comprising a hull 3 having a longitudinal extent along a hull longitudinal axis L, and a lateral extent along a hull lateral axis T. The drive unit 2 comprises a mount 4 attaching the drive unit 2 to the hull 3 along said hull longitudinal axis L. The drive unit 2 also comprises a lower unit 5 comprising a propeller shaft 6 for carrying a propeller for generating thrust.

The lower unit 5 is configured such that the lower unit 5, or at least a portion of the lower unit 5 carrying the propeller shaft 6, is rotatable about a steering axis S such that a direction of a horizontal component 12, 13 of the thrust is variable in a horizontal plane by rotation of the lower unit 5 about the steering axis S.

In other embodiments, the drive unit 2 may be provided with more than one propeller, for example two propellers, wherein the propeller shaft 6 is replaced by one propeller shaft 6 for each propeller, typically coaxial and configured to rotate in opposite rotational directions to provide duo prop functionality.

The method M comprises obtaining, by a processor device 19 of a computer system 11, net momentum direction data DM indicative of a target horizontal rotational movement of the hull 3.

The method further comprises triggering, by the processor device 19, a series of bursts of thrust by the drive unit 2, said series of bursts of thrust comprising a plurality of primary bursts B1 and a plurality of secondary bursts B2 directed differently than the primary bursts B1. The primary bursts B1 and the secondary bursts B2 are directed such that they provide a respective longitudinal thrust component 13 parallel to the hull longitudinal axis L. The primary bursts are directed such that the longitudinal thrust components 13 of the primary bursts B1 act in the opposite direction with respect to the direction of the longitudinal thrust components 13 of the secondary bursts B2. Also, the primary bursts B1 and the secondary bursts B2 are further directed such that they jointly provide a net momentum on the hull 3 associated with said net momentum direction data DM.

The series of bursts of thrust act in different directions and jointly contribute to provide at least a net momentum on the hull 3 in a horizontal plane, which could be a zero net momentum or a positive net momentum in any momentum direction chosen based on the momentum direction data.

The primary bursts together provide a net longitudinal force component 13 at least partly counteracting a net longitudinal force component 13 provided by the secondary bursts.

By adapting the power (intensity and time) of each burst, a net longitudinal force applied by the series of bursts along the hull longitudinal axis is controllable, for example to be zero/neutral, or to act to propel the boat 1 forward or backward.

Since the primary bursts and the secondary bursts are also directed such that they jointly provide a net momentum on the hull 3 associated with said net momentum direction data, control of rotational movement and of longitudinal movement can be achieved using only a single drive unit 2, with reduced manual attention required by an operator of the boat 1, and with less space required around the boat 1 for achieving the rotational maneuver. The association between the net momentum direction data and the net momentum provided may for example be that the data defines a rotational direction, such as clockwise or counterclockwise, and that the net momentum applied is such that it achieves the same clockwise or counterclockwise rotation of the boat 1 as defined by the data.

The method may use any suitable control strategy for controlling a net longitudinal direction of movement, for example a dynamically user controllable net direction, or a statically defined net movement such as forward, backward or neutral/still.

Further, the method may use any suitable control strategy for controlling a net longitudinal force/speed of movement, for example a dynamically user controllable net longitudinal force, or a statically defined net longitudinal force. Further, one or more sensors may be used provide information about actual position or acceleration of the boat 1, wherein the method could comprise adapting the strength and direction or thrust to achieve a target rate of translation of the position of the boat 1, which would account for external factors acting on the boat 1, such as wind and water currents. The rate of translation of the boat 1 could be dynamically user controllable, or it could be a static rate.

Net momentum direction data may for example be provided by an automated navigation system programmed to perform specific maneuvers and/or follow a specific path, or the net momentum direction data may be provided by manual control by an operator of the boat 1. For example, the operator may operate a joystick controlling output of at least net momentum direction data. In the case of manual control, this means that the operator only needs to ensure that net momentum direction data is available and can thus focus control efforts on monitoring actual rotational movements of the vessel and adapting the manual input to control at least the momentum direction data as required, for example by continuously adjusting the joystick (or other suitable control device) until the boat 1 reaches and/or maintains an intended rotational position.

The method may use any suitable control strategy for determining net momentum strength, for example using a dynamically user controllable momentum strength, or a statically defined momentum strength. Further, one or more sensors may be used provide information about actual position or acceleration of the boat 1, wherein the method could comprise adapting the momentum strength to a target rate of change of the rotational position of the boat 1, which would account for external factors acting on the boat 1, such as wind and water currents. The rate could be dynamically user controllable, or it could be a static rate.

Further, the method may use any suitable control strategy for controlling a net longitudinal force/speed of movement, for example a dynamically user controllable net longitudinal force, or a statically defined net longitudinal force.

Also, it should be understood that the speed of the propeller shaft(s) 6 is lowered between consecutive bursts; However, the speed of the propeller shaft(s) 6 must not necessarily be lowered to standstill of the propeller shaft(s) 6 between consecutive bursts.

Also, all primary bursts must not necessarily have the same direction, nor the same power. Similarly, all secondary bursts must not necessarily have the same direction, nor the same power.

The method M may further comprise obtaining, by the processor device 19, net force direction data DF indicative of a target horizontal translational movement of the hull 3. The direction of the primary bursts B1 and of the secondary bursts B2 are further such that the primary bursts B1 and secondary bursts B2 jointly provide a net force on the hull 3 associated with the target horizontal translational movement of the hull 3.

The target horizontal translational movement may be directed in any horizontal direction and thus be used to derive the net longitudinal thrust component 13 and a net lateral thrust component 12 directed perpendicularly to the hull longitudinal axis. By adjusting the direction and net power of the primary burst and of the secondary bursts, the hull 3 will be affected by a net lateral force component 12 in a net lateral force direction associated with the net force direction data, and by the net longitudinal force discussed above.

The association between the net force direction data and the net force provided may for example be that the data defines a direction of translation of the boat 1 (in a horizontal plane), for example a sideways translation and/or a longitudinal translation, and that the net force applied is such that it achieves translation of the boat 1 in the same direction as defined by the data.

The triggered series of bursts may alternate between respective ones of, or respective subsets of, the primary bursts B1, and respective ones of, or respective subsets of, the secondary bursts B2.

Firstly, it should be understood that not all primary bursts must necessarily have a same direction and a same power, although they could have. Also, not all secondary bursts must necessarily have a same direction and a same power, although they could have.

Secondly, if all primary bursts would be provided first, and all secondary bursts would be provided after all the primary bursts, the boat 1 would be given a relatively large translational movement in one direction before the secondary bursts are applied. By providing the primary bursts and the secondary bursts in an alternating fashion, as described above, a relatively small translational movement of the hull 3 is made possible, since the longitudinal components 13 of the forces applied at least partly cancel each other out. This enables rotation of the boat 1 without, or with only little, horizontal translational movement of the boat 1. This increases accuracy of the movement of the boat 1 (including accuracy of any rotational and any translational movement intended).

As shown in FIGS. 4*a*, 4*b*, 5*a*, 5*b*, and 14-19, each burst of said series of bursts may be directed such that it provides a respective lateral thrust component 12 perpendicular to the hull longitudinal axis L, wherein the respective lateral thrust components 12 of the primary bursts B1 are directed in a same direction as the direction of the respective lateral thrust components 12 of the secondary bursts B2, wherein the primary bursts B1 and the secondary bursts B2 and jointly contribute to a net lateral force on the hull 3 in said associated with a lateral component 12 of the target horizontal translational movement. Since both the primary burst and the secondary bursts contribute to a net lateral force component 12, they collaborate with each other and do not work against each other, thus enabling a higher efficiency of the thrust power used for achieving lateral movement of the hull 3.

The respective rotational direction of the propeller(s) may be reversed for the secondary bursts B2 as compared to the respective rotational direction of the propeller(s) used for the primary bursts B1, as shown in FIGS. 4*a*, 5*a*, and 8-19.

Reversing the rotational direction of a propeller reverses its thrust direction. Reversing the propeller thrust direction enables unconstrained operation also for drive units 2 not capable of rotating 360 degrees in a horizontal plane, for example transom mounted drive units 2. Also, reversal of the rotational direction of the propeller(s) enables shorter travel between a drive unit position from which the primary bursts are applied and a drive unit position from which the secondary bursts are applied. For example, FIG. 4*a* shows the same thrust angle as the one shown in FIG. 4*b*, and FIG. 5*a* shows the same thrust angles as shown in FIG. 5*b*. In FIGS. 4*a* and 4*b*, the steering angle of the drive unit 2 is changed less between the primary bursts and the secondary bursts, than in the operation shown in FIGS. 4*b* and 5*b* where the drive unit 2 has to rotate much longer to be able to achieve the same thrust direction. The rotational direction of the propeller(s) can be the same for the primary and the secondary burst in the FIG. 4*b* operation, whereas the rotational direction of the propeller(s) has to be changed in the FIG. 4*a* operation to achieve the correct thrust direction. Transom mounted drive units 2 typically cannot be operated as shown in FIGS. 4*b* and 5*b*.

As mentioned above and shown in FIGS. 1-3 and 8-21, the drive unit 2 may be configured such that a pivot point PP of the lower unit 5 at an intersection of the steering axis S and a central axis of the propeller shaft 6, is laterally movable with respect to the hull longitudinal axis L between a starboard operative range RS on a starboard side of the hull longitudinal axis L, and a port operative range RP on the port side of the hull longitudinal axis L (see FIG. 8). The primary bursts B1 are provided with the lower unit 5 positioned such that the pivot point PP is within the starboard operative range RS, and wherein the secondary bursts B2 are provided with the lower unit 5 positioned such that the pivot point PP is within the port operative range RP.

The lateral movement of the pivot point enables lateral movement of the longitudinal axis along which application of thrust is provided by the propeller(s) and thus enables a net momentum (for rotation of the hull 3 in a horizontal plane) to be applied to the hull 3 whilst enabling control of the net force direction and net force strength. This further enables rotation on the spot with little to no net lateral or, net longitudinal, translation of the hull 3, as shown in FIGS. 8-13. Since both net momentum and net force is controllable, it is also possible to provide little to no net momentum whilst still being able to move the hull 3 laterally only as shown in FIGS. 14-17. From any pivot point position, it is possible to alter the strength and direction of momentum applied by altering the steering angle; For example to reach a state where the momentum from the primary bursts cancel the momentum from the secondary bursts, or to reach a state where the series of bursts are directed towards a center of mass 27 of the boat 1, such that the bursts do not create a momentum around the center of mass 27, and hence a zero/neutral net momentum.

The lower unit 5 may be rotatably attached to the mount 4 for rotation of the lower unit 5 about a second rotational axis 9 substantially parallel to the hull longitudinal axis L, wherein the propeller shaft 6 is radially offset from the second rotational axis 9 such that the propeller shaft 6 is movable laterally with respect to the hull longitudinal axis L by rotation of the lower unit 5 about the second rotational axis 9.

Each burst of said series of bursts may be directed along a respective directional axis extending straight through a vertical reference axis extending through a center of mass 27 of the boat 1. When the series of bursts are directed towards a center of mass 27 of the boat 1, the bursts do not create a momentum around the center of mass 27, and hence a zero/neutral net momentum on the boat 1.

The method M may further comprise obtaining, by the processor device 19, net momentum strength data SM and net force strength data SF. Also, the method M may comprise controlling, by the processor device 19, direction and/or power of the respective bursts of the series of bursts based on the net momentum strength data SM and based on the net force strength data SF.

The method M may further comprise providing a manually operable input device 10 configured to enable user input of at least a net force direction and/or a net momentum direction, said method M further comprising providing, by the processor device 19, said net force direction data DF and/or said net momentum direction data DM based on said user input from the input device 10.

The input device 10 may also be configured to enable user input of at least a net force strength and a net momentum strength, wherein the method M further comprises providing, by the processor device 19, said net force strength data and said net momentum strength data based on said user input from the input device 10.

The user input device 10 may comprise a joystick. The joystick may be a joystick with three or more axes of control. The joystick may comprise a joystick lever and may be a progressive input joystick configured enable user input of both said net force direction and of a net force strength based on the direction of tilt of the joystick lever and amount of tilt of a joystick lever, and configured to enable user input of both said net momentum direction, based on the direction of rotation of the joystick lever about a longitudinal axis of the joystick lever, and of a net momentum strength, based on the amount of rotation of the joystick lever about the longitudinal axis of the joystick lever.

According to an aspect, a computer system may be provided for installation on the boat 1. The computer system 11 comprises a processor device 19 configured to perform the method M according to any one of claims 1-16, i.e. the method described above.

According to an aspect, a control system is provided comprising one or more control units configured to perform the method M according to any one of claims 1-16, i.e. the method described above.

According to an aspect, a computer program product is provided comprising program code for performing, when executed by the processor device 19, the method M according to any one of claims 1-16.

According to an aspect, a boat 1 is provided, said boat 1 comprising the computer system 11 comprising the processor device 19 configured to perform, when executed by the processor device 19, the method M according to any one of claims 1-16.

According to an aspect, a non-transitory computer-readable storage medium is provided comprising instructions, which when executed by the processor device 19, cause the processor device 19 to perform the method according to any one of claims 1-16.

FIG. 23 is a schematic diagram of a computer system 11 for implementing examples disclosed herein. The computer system 11 is adapted to execute instructions from a computer-readable medium to perform these and/or any of the functions or processing described herein. The computer system 11 may be connected (e.g., networked) to other machines in a LAN, an intranet, an extranet, or the Internet. While only a single device is illustrated, the computer system 11 may include any collection of devices that individually or jointly execute a set (or multiple sets) of instructions to perform any one or more of the methodologies discussed herein. Accordingly, any reference in the disclosure and/or claims to a computer system 11, computing system, computer device, computing device, control system, control unit, electronic control unit (ECU), processor device, etc., includes reference to one or more such devices to individually or jointly execute a set (or multiple sets) of instructions to perform any one or more of the methodologies discussed herein. For example, control system may include a single control unit or a plurality of control units connected or otherwise communicatively coupled to each other, such that any performed function may be distributed between the control units as desired. Further, such devices may communicate with each other or other devices by various system architectures, such as directly or via a Controller Area Network (CAN) bus, etc.

The computer system 11 may comprise at least one computing device or electronic device capable of including firmware, hardware, and/or executing software instructions to implement the functionality described herein. The computer system 11 may include a processor device 19 (may also be referred to as a control unit), a memory 25, and a system bus 18. The computer system 11 may include at least one computing device having the processor device 19. The system bus 18 provides an interface for system components including, but not limited to, the memory 25 and the processor device 19. The processor device 19 may include any number of hardware components for conducting data or signal processing or for executing computer code stored in memory 25. The processor device 19 (e.g., control unit) may, for example, include a general-purpose processor, an application specific processor, a Digital Signal Processor (DSP), an Application Specific Integrated Circuit (ASIC), a Field Programmable Gate Array (FPGA), a circuit containing processing components, a group of distributed processing components, a group of distributed computers configured for processing, or other programmable logic device, discrete gate or transistor logic, discrete hardware components, or any combination thereof designed to perform the functions described herein. The processor device 19 may further include computer executable code that controls operation of the programmable device.

The system bus 18 may be any of several types of bus structures that may further interconnect to a memory bus (with or without a memory controller), a peripheral bus, and/or a local bus using any of a variety of bus architectures. The memory 25 may be one or more devices for storing data and/or computer code for completing or facilitating methods described herein. The memory 25 may include database components, object code components, script components, or other types of information structure for supporting the various activities herein. Any distributed or local memory device may be utilized with the systems and methods of this description. The memory 25 may be communicably connected to the processor device 19 (e.g., via a circuit or any other wired, wireless, or network connection) and may include computer code for executing one or more processes described herein. The memory 25 may include non-volatile memory 23 (e.g., read-only memory (ROM), erasable programmable read-only memory (EPROM), electrically erasable programmable read-only memory (EEPROM), etc.), and volatile memory 21 (e.g., random-access memory (RAM)), or any other medium which can be used to carry or store desired program code in the form of machine-executable instructions or data structures and which can be accessed by a computer or other machine with a processor device 19. A basic input/output system (BIOS) 26 may be stored in the non-volatile memory 23 and can include the basic routines that help to transfer information between elements within the computer system 11.

The computer system 11 may further include or be coupled to a non-transitory computer-readable storage medium such as the storage device 14, which may comprise, for example, an internal or external hard disk drive (HDD) (e.g., enhanced integrated drive electronics (EIDE) or serial advanced technology attachment (SATA)), HDD (e.g., EIDE or SATA) for storage, flash memory, or the like. The storage device 14 and other drives associated with computer-readable media and computer-usable media may provide non-volatile storage of data, data structures, computer-executable instructions, and the like.

A number of modules can be implemented as software and/or hard coded in circuitry to implement the functionality described herein in whole or in part. The modules may be stored in the storage device 14 and/or in the volatile memory 21, which may include an operating system 20 and/or one or more program modules 24. All or a portion of the examples disclosed herein may be implemented as a computer program product 22 stored on a transitory or non-transitory computer-usable or computer-readable storage medium (e.g., single medium or multiple media), such as the storage device 14, which includes complex programming instructions (e.g., complex computer-readable program code) to cause the processor device 19 to carry out the steps described herein. Thus, the computer-readable program code can comprise software instructions for implementing the functionality of the examples described herein when executed by the processor device 19. The processor device 19 may serve as a controller or control system for the computer system 11 that is to implement the functionality described herein.

The computer system 11 also may include an input device interface 15 (e.g., input device interface and/or output device interface). The input device interface 15 may be configured to receive input and selections to be communicated to the computer system 11 when executing instructions, such as from a keyboard, mouse, touch-sensitive surface, joystick, etc. Such input devices may be connected to the processor device 19 through the input device interface 15 coupled to the system bus 18 but can be connected through other interfaces such as a parallel port, an Institute of Electrical and Electronic Engineers (IEEE) 1394 serial port, a Universal Serial Bus (USB) port, an IR interface, and the like. The computer system 11 may include an output device interface 17 configured to forward output, such as to a display, a video display unit (e.g., a liquid crystal display (LCD) or a cathode ray tube (CRT)). The computer system 11 may also include a communications interface 16 suitable for communicating with a network as appropriate or desired.

The operational steps described in any of the exemplary aspects herein are described to provide examples and discussion. The steps may be performed by hardware components, may be embodied in machine-executable instructions to cause a processor to perform the steps, or may be performed by a combination of hardware and software. Although a specific order of method steps may be shown or described, the order of the steps may differ. In addition, two or more steps may be performed concurrently or with partial concurrence.

Table of reference numerals

| | |
|---|---|
| 1 | boat |
| 2 | drive unit |
| 3 | hull |
| 4 | mount |
| 5 | lower unit |
| 6 | propeller shaft |
| 7 | central body of drive unit |
| 8 | first rotational axis |
| 9 | second rotational axis |
| 10 | manually operable input device |
| 11 | computer system |
| 12 | lateral force component |
| 13 | longitudinal force component |
| 14 | storage device |

-continued

Table of reference numerals

| | |
|---|---|
| 15 | input device interface |
| 16 | communications interface |
| 17 | output device interface |
| 18 | system bus |
| 19 | processor device |
| 20 | operating system |
| 21 | volatile memory |
| 22 | computer program product |
| 23 | non-volatile memory |
| 24 | program module |
| 25 | memory |
| 26 | BIOS |
| 27 | center of mass of boat |
| L | hull longitudinal axis |
| T | hull lateral axis |
| V | hull vertical axis |
| S | steering axis |
| DM | net momentum direction data |
| DF | net force direction data |
| SM | net momentum strength data |
| SF | net force strength data |
| B1 | primary bursts |
| B2 | secondary bursts |
| DR | direction of rotation of hull |
| DT | direction of translation of hull |
| PP | pivot point |
| M | method for maneuvering a boat |

The invention claimed is:

1. A computer-implemented method for maneuvering a boat provided with a single drive unit, said boat comprising a hull having a longitudinal extent along a hull longitudinal axis, and a lateral extent along a hull lateral axis, said drive unit comprising:

a mount attaching the drive unit to the hull along said hull longitudinal axis, a lower unit comprising a propeller shaft for carrying a propeller for generating thrust, wherein the lower unit is configured such that the lower unit, or at least a portion of the lower unit carrying the propeller shaft, is rotatable about a steering axis such that a direction of a horizontal component of the thrust is variable in a horizontal plane by rotation of the lower unit about the steering axis, wherein the method comprises:

obtaining, by a processor device of a computer system, net momentum direction data indicative of a target horizontal rotational movement of the hull, triggering, by the processor device, a series of bursts of thrust by the drive unit, said series of bursts of thrust comprising a plurality of primary bursts and a plurality of secondary bursts directed differently than the primary bursts, wherein the primary bursts and the secondary bursts are directed such that they provide a respective longitudinal thrust component parallel to the hull longitudinal axis, wherein the primary bursts are directed such that the longitudinal thrust components of the primary bursts act in the opposite direction with respect to the direction of the longitudinal thrust components of the secondary bursts, and wherein the primary bursts and the secondary bursts are further directed such that they jointly provide a net momentum on the hull associated with said net momentum direction data.

2. The method according to claim 1, wherein the method further comprises obtaining, by the processor device, net force direction data indicative of a target horizontal translational movement of the hull, wherein the direction of the primary bursts and of the secondary bursts are further such that the primary bursts and secondary bursts jointly provide a net force on the hull associated with the target horizontal translational movement of the hull.

3. The method according to claim 1, wherein the triggered series of bursts alternates between respective ones of, or respective subsets of, the primary bursts, and respective ones of, or respective subsets of, the secondary bursts.

4. The method according to claim 2, wherein each burst of said series of bursts is directed such that it provides a respective lateral thrust component perpendicular to the hull longitudinal axis, wherein the respective lateral thrust components of the primary bursts are directed in a same direction as the direction of the respective lateral thrust components of the secondary bursts, wherein the primary bursts and the secondary bursts and jointly contribute to a net lateral force on the hull in said associated with a lateral component of the target horizontal translational movement.

5. The method according to claim 1, wherein a respective rotational direction of the propeller (s) is reversed for the secondary bursts as compared to the respective rotational direction of the propeller(s) used for the primary bursts.

6. The method according to claim 1, wherein the drive unit is configured such that a pivot point of the lower unit at an intersection of the steering axis and a central axis of the propeller shaft, is laterally movable with respect to the hull longitudinal axis between a starboard operative range on a starboard side of the hull longitudinal axis, and a port operative range on the port side of the hull longitudinal axis, wherein the primary bursts are provided with the lower unit positioned such that the pivot point is within the starboard operative range, and wherein the secondary bursts are provided with the lower unit positioned such that the pivot point is within the port operative range.

7. The method according to claim 6, wherein the drive unit further comprises:

a central body rotatably attached to the mount for rotation about a first rotational axis extending substantially vertically, or extending with an angle to a vertical axis within the range of 1-20 degrees, such as within 1-10 degrees, wherein the lower unit is attached to the central body radially offset with respect to the first rotational axis such that the steering axis is laterally movable with respect to the hull longitudinal axis by rotation of the central body about the first rotational axis.

8. The method according to claim 6, wherein the lower unit is rotatably attached to the mount for rotation of the lower unit about a second rotational axis substantially parallel to the hull longitudinal axis, wherein the propeller shaft is radially offset from the second rotational axis such that the propeller shaft is movable laterally with respect to the hull longitudinal axis by rotation of the lower unit about the second rotational axis.

9. The method according to claim 1, wherein each burst of said series of bursts is directed along a respective directional axis extending straight through a vertical reference axis extending through a center of mass of the boat.

10. The method according to claim 1, further comprising obtaining, by the processor device, net momentum strength data and net force strength data, and further comprising controlling, by the processor device, direction and/or power of the respective bursts of the series of bursts based on the net momentum strength data and based on the net force strength data.

11. The method according to claim 1, further comprising providing a manually operable input device configured to enable user input of at least a net force direction and/or a net momentum direction, said method further comprising providing, by the processor device, said net force direction data and/or said net momentum direction data based on said user input from the input device.

12. The method according to claim 11, wherein the input device is also configured to enable user input of at least a net force strength and a net momentum strength, said method further comprising providing, by the processor device, said net force strength data and said net momentum strength data based on said user input from the input device.

13. The method according to claim 12, wherein the user input device comprises a joystick.

14. The method according to claim 13, wherein the joystick is a joystick with three or more axes of control.

15. The method according to claim 14, wherein the joystick comprises a joystick lever and is a progressive input joystick configured enable user input of both said net force direction and of a net force strength based on the direction of tilt of the joystick lever and amount of tilt of a joystick lever, and configured to enable user input of both said net momentum direction, based on the direction of rotation of the joystick lever about a longitudinal axis of the joystick lever, and of a net momentum strength, based on the amount of rotation of the joystick lever about the longitudinal axis of the joystick lever.

16. The computer system comprising the processor device configured to perform the method according to claim 1.

17. A control system comprising one or more control units configured to perform the method of claim 1.

18. A computer program product comprising program code for performing, when executed by the processor device, the method according to claim 1.

19. The boat further comprising the computer system comprising the processor device configured to perform, when executed by the processor device, the method according to claim 1.

20. A non-transitory computer-readable storage medium comprising instructions, which when executed by the processor device, cause the processor device to perform the method of claim 1.

* * * * *